US009175896B2

(12) United States Patent
Choi

(10) Patent No.: US 9,175,896 B2
(45) Date of Patent: Nov. 3, 2015

(54) REFRIGERATOR WITH A PLURALITY OF SEALING PARTS

(75) Inventor: Sang Phil Choi, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 930 days.

(21) Appl. No.: 12/755,654

(22) Filed: Apr. 7, 2010

(65) Prior Publication Data

US 2011/0146326 A1 Jun. 23, 2011

(30) Foreign Application Priority Data

Dec. 22, 2009 (KR) ..... 10-2009-0129253

(51) Int. Cl.
*F25C 5/18* (2006.01)
*F25D 19/00* (2006.01)
*F25D 23/02* (2006.01)

(52) U.S. Cl.
CPC .. *F25C 5/18* (2013.01); *F25D 23/02* (2013.01)

(58) Field of Classification Search
CPC ..... F25D 23/02; F25C 5/18
USPC ..... 62/340, 344, 449, 447, 345, 353
See application file for complete search history.

(56) References Cited

U.S. PATENT DOCUMENTS 4,722,199 A * 2/1988 Hibino ..... 62/344
4,829,652 A * 5/1989 Haas et al. ..... 29/451
2002/0117949 A1* 8/2002 Banicevic et al. ..... 312/407
2002/0153817 A1* 10/2002 Wenning et al. ..... 312/406
2004/0178711 A1* 9/2004 Avendano ..... 312/405.1
2004/0237569 A1* 12/2004 Lee et al. ..... 62/353
2006/0086132 A1* 4/2006 Maglinger et al. ..... 62/344
2007/0074527 A1* 4/2007 Lee et al. ..... 62/344
2007/0095090 A1* 5/2007 Kuehl et al. ..... 62/344
2008/0280090 A1* 11/2008 Kim et al. ..... 428/69
2009/0249820 A1* 10/2009 Kim et al. ..... 62/344
2010/0024464 A1* 2/2010 Hwang et al. ..... 62/377
2010/0071404 A1* 3/2010 Han et al. ..... 62/441
2010/0122548 A1* 5/2010 Kim et al. ..... 62/344
2010/0126202 A1* 5/2010 Flores et al. ..... 62/344
2010/0147001 A1* 6/2010 Kim et al. ..... 62/259.1

FOREIGN PATENT DOCUMENTS

JP 08-100991 * 4/1996
WO WO 2008/007901 * 1/2008

* cited by examiner

*Primary Examiner* — Allana Lewin Bidder
*Assistant Examiner* — Dawit Muluneh
(74) *Attorney, Agent, or Firm* — Fish & Richardson P.C.

(57) ABSTRACT

Provided is a refrigerator that includes a cabinet, a refrigerator door, and a cabinet sealing part. The cabinet defines a storage compartment. The refrigerator door opens and closes the storage compartment. The cabinet sealing part is provided to a contact portion between the refrigerator door and the cabinet to prevent a communication between the storage compartment and an outside. The refrigerator door includes a door liner defining an ice compartment, an ice maker in the ice compartment, the ice maker generating ice, an ice bin storing ice generated by the ice maker, an ice compartment door opening and closing the ice compartment, and a plurality of sealing parts at positions spaced apart from each other. The sealing parts prevent a communication between the ice compartment and the storage compartment.

10 Claims, 9 Drawing Sheets

REFRIGERATOR WITH A PLURALITY OF SEALING PARTS

CROSS-REFERENCE TO RELATED APPLICATIONS

The present application claims priority under U.S.C. 119 and 35 U.S.C. 365 to Korean Patent Application No. 10-2009-0129253 (filed on Dec. 22, 2009), which is hereby incorporated by reference in its entirety.

BACKGROUND

The present disclosure relates to a refrigerator.

Generally, a refrigerator is an apparatus that stores foods at a low temperature using low temperature air.

The refrigerator includes a cabinet in which a storage compartment is defined and a refrigerator door opening and closing the storage compartment. The storage compartment may include a refrigerator compartment and a freezer compartment. The refrigerator door may include a refrigerator compartment door opening and closing the refrigerator compartment and a freezer compartment door opening and closing the freezer compartment.

Also, the refrigerator may include an ice making assembly that makes ice using cool air to store the made ice. The ice making assembly includes an ice maker generating ice and an ice bin in which ice removed from the ice maker is stored. For user's convenience, the refrigerator compartment door may further include a dispenser for dispensing ice stored in the ice bin.

SUMMARY

Embodiments provide a refrigerator.

In one embodiment, a refrigerator includes: a cabinet defining a storage compartment; a refrigerator door configured to open and close the storage compartment; and a cabinet sealing part provided to a contact portion between the refrigerator door and the cabinet to prevent a communication between the storage compartment and an outside, wherein the refrigerator door includes a door liner defining an ice compartment; an ice maker provided within the ice compartment, the ice maker generating ice; an ice bin configured to store ice generated by the ice maker; an ice compartment door configured to open and close the ice compartment; and a plurality of sealing parts configured to prevent a communication between the ice compartment and the storage compartment, the sealing parts being spaced apart from each other.

In another embodiment, a refrigerator includes: a cabinet defining a storage compartment; a refrigerator door configured to open and close the storage compartment; and a cabinet sealing part provided to a contact portion between the refrigerator door and the cabinet to prevent a communication between the storage compartment and an outside, wherein the refrigerator door includes a refrigerator door liner defining an ice compartment; an ice maker disposed within the ice compartment; an ice bin configured to store ice generated by the ice maker; and an ice compartment door configured to open and close the ice compartment and including an ice compartment door liner, wherein, when the ice compartment door closes the ice compartment, at least a portion of the ice compartment door liner is inserted in the ice compartment to prevent a communication between the ice compartment and the storage compartment.

In further another embodiment, a refrigerator includes: a cabinet defining a refrigerator compartment; a refrigerator door configured to open and close the refrigerator compartment; and a cabinet sealing part provided to a contact portion between the refrigerator compartment door and the cabinet to prevent a communication between the refrigerator compartment and an outside, wherein the refrigerator compartment door includes a door liner defining an ice compartment; an ice maker disposed within the ice compartment, the ice maker generating ice; an ice bin configured to store ice generated by the ice maker; an ice compartment door configured to open and close the ice compartment; a first sealing part positioned at a contact portion between the ice compartment door and the door liner, the first sealing part preventing a communication between the ice compartment and the refrigerator compartment; and a second sealing part spaced apart from the first sealing part and preventing the communication between the ice compartment and the refrigerator compartment inside the first sealing part.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
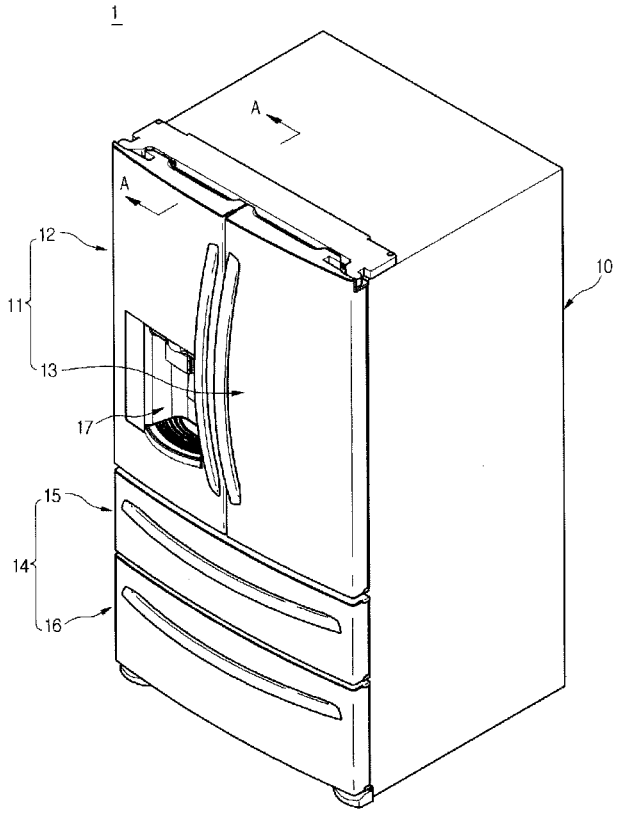
FIG. 1 is a perspective view of a refrigerator according to a first embodiment.
Figure 2:
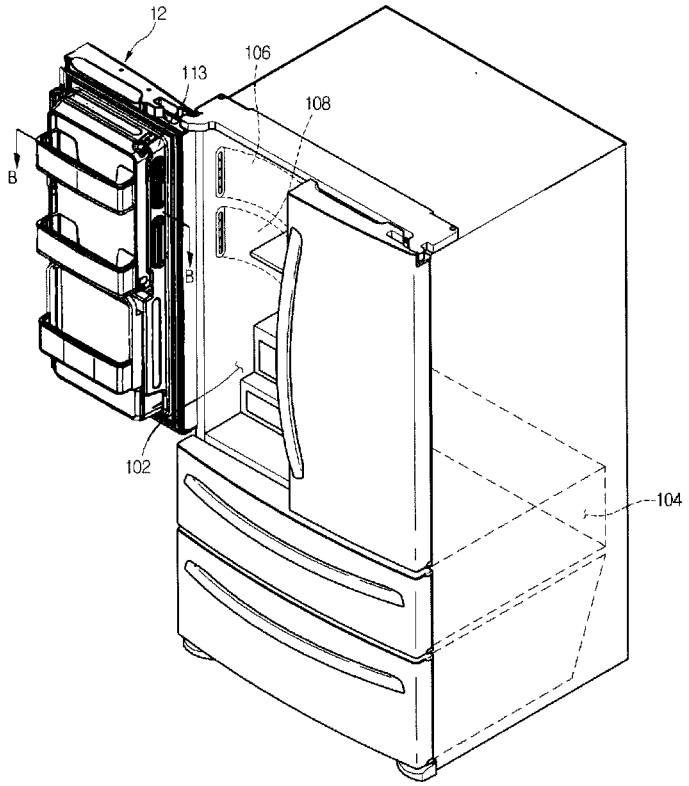
FIG. 2 is a perspective view illustrating a state where a portion of a refrigerator door is opened, according to the first embodiment.

FIG. 1 is a perspective view of a refrigerator according to a first embodiment. FIG. 2 is a perspective view illustrating a state where a portion of a refrigerator door is opened, according to the first embodiment.

Referring to FIGS. 1 and 2, a refrigerator 1 according to the embodiment includes a cabinet 10 defining an outer appearance of the refrigerator 1, and refrigerator doors 11 and 14 movably connected to the cabinet 10.

A storage compartment for storing foods is defined inside the cabinet 10. The storage compartment includes a refrigerator compartment 102 and a freezer compartment 104 disposed below the refrigerator compartment 102.

That is, a bottom freeze type refrigerator in which a refrigerator compartment is disposed above a freezer compartment will be exemplified in the current embodiment.

The refrigerator door 11 and 14 may be respectively referred to as a refrigerator compartment door opening and closing the refrigerator compartment 102, and a freezer compartment door opening and closing the freezer compartment 104.

The refrigerator compartment door 11 includes a plurality of doors 12 and 13 that are disposed at left and right sides, respectively. The doors 12 and 13 include a first refrigerator compartment door that is also denoted by 12 and a second refrigerator compartment door that is also denoted by 13 and disposed at a right side of the first refrigerator compartment door 12. The first refrigerator compartment door 12 may be independently movable with respect to the second refrigerator compartment door 13.

The freezer compartment door 14 includes a plurality of doors 15 and 16 that are vertically arrayed. The doors 15 and 16 include a first freezer compartment door 15 and a second freezer compartment door 16 disposed below the first freezer compartment door 15.

The first and second refrigerator compartment doors 12 and 13 may be rotatably moved, and the first and second freezer compartment doors 15 and 16 may be slidably moved.

A dispenser 17 for dispensing water or ice is disposed in one of the first and second refrigerator compartment doors 12 and 13. For example, the dispenser 17 is disposed in the first refrigerator door 12 in FIG. 1.

Also, an ice making assembly (that will be described later) for generating and storing the ice is disposed in one of the first and second refrigerator compartment doors 12 and 13.

In the current embodiment, the dispenser 17 and the ice making assembly may be disposed in the first refrigerator compartment door 12 or the second refrigerator compartment door 13. Thus, it will be described below that the dispenser 17 and the ice making assembly are disposed in the refrigerator compartment door 11 including the first refrigerator compartment door 12 and the second refrigerator compartment door 13.

Figure 3:
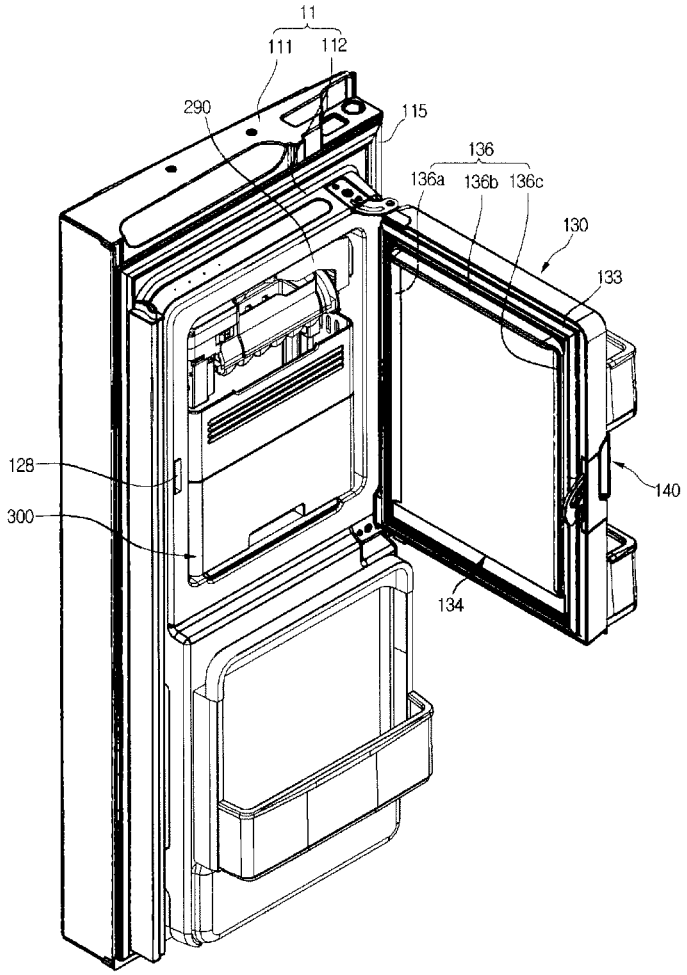
FIG. 3 is a perspective view of the refrigerator compartment door with an ice compartment door opened according to the first embodiment.
Figure 4:
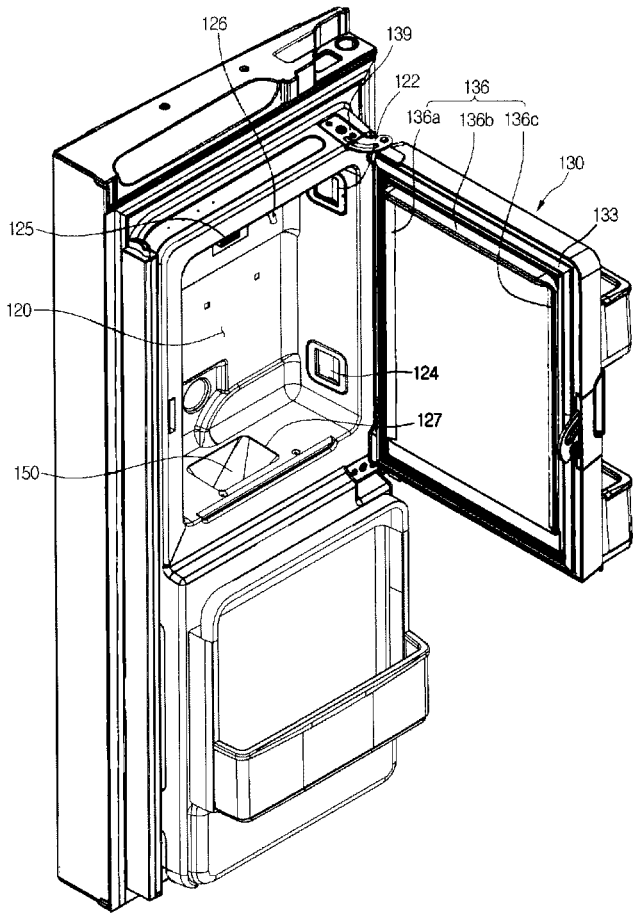
FIG. 4 is a perspective view of the refrigerator compartment door in which an ice making assembly is removed from the ice compartment according to the first embodiment.

FIG. 3 is a perspective view of the refrigerator compartment door with an ice compartment door opened, according to the first embodiment. FIG. 4 is a perspective view of the refrigerator compartment door in which the ice making assembly is removed from the ice compartment, according to the first embodiment.

Referring to FIGS. 1 to 4, the refrigerator compartment door 11 includes an outer case 111 and a door liner 112 coupled to the outer case 111. The door liner 112 defines a back surface of the refrigerator compartment door 11. An insulation material is disposed between the outer case 111 and the door liner 112.

The door liner 112 includes a cabinet sealing part 115 that may include, e.g., a gasket formed of elastic material.

When the refrigerator compartment door 11 closes the refrigerator compartment 102, the cabinet sealing part 115 is in close contact with the front surface of the cabinet 10. The cabinet sealing part 115 prevents cool air of the cabinet 10 from being leaked to the outside when the refrigerator compartment door 11 closes the refrigerator compartment 102. That is, the cabinet sealing part 115 prevents the refrigerator compartment 102 from communicating with the outside of the refrigerator 1.

The door liner 112 defines an ice compartment 120. An ice making assembly 200 for generating and storing ice is disposed inside the ice compartment 120. The ice compartment 120 is opened and closed by an ice compartment door 130. The ice compartment door 130 is rotatably connected to the door liner 112 by a hinge 139. A handle 140 is disposed on the ice compartment door 130 to couple the compartment door 130 to the door liner 112 when the ice compartment 120 is closed by the ice compartment door 130.

A handle coupling part 128 coupled to a portion of the handle 140 is defined in the door liner 112. The handle coupling part 128 receives the portion of the handle 140.

The ice compartment door 130 includes a plurality of sealing parts 133 and 134 for preventing the leakage of cool air of the ice compartment 120. The sealing parts 133 and 134 will be described later.

The cabinet 10 includes a main body supply duct 106 for supplying cool air to the ice compartment 120 and a main body return duct 108 for recovering the cool air from the ice compartment 120. The main body supply duct 106 and the main body return duct 108 may communicate with a space in which an evaporator (not shown) is disposed.

The refrigerator compartment door 11 includes a door supply duct 122 for supplying the cool air of the main body supply duct 106 to the ice compartment 120, and a door return duct 124 for recovering the cool air of the ice compartment 120 to the main body return duct 108.

The door supply duct 122 and the door return duct 124 extend from an outer wall 113 of the door liner 112 to an inner wall 114 constituting the ice compartment 120. The door supply duct 122 and the door return duct 124 are vertically arrayed, and the door supply duct 122 is disposed over the door return duct 124. However, in the current embodiment, the positions of the door supply duct 122 and the door return duct 124 are not limited thereto.

When the refrigerator compartment door 11 closes the refrigerator compartment 102, the door supply duct 122 is aligned and communicates with the main body supply duct 106, and the door return duct 124 is aligned and communicates with the main body return duct 108.

The ice compartment 120 is provided with a cool air duct 290 guiding cool air flowing in the door supply duct 122 to the ice making assembly 200. The cool air duct 290 includes a passage through which cool air flows, and cool air flowing in the cool air duct 290 is finally supplied to the ice making assembly 200. Since cool air may be concentrated to the ice making assembly 200 through the cool air duct 290, ice can be rapidly generated.

The refrigerator compartment door 11 includes a first connector 125 for supplying an electric source to the ice making assembly 200. The first connector 125 is exposed to the ice compartment 120. The refrigerator compartment door 11 is provided with a water supply pipe 126 for supplying water to the ice making assembly 200.

The water supply pipe 126 is disposed between the outer case 111 and the door liner 112, its end passes through the door liner 112 and is disposed at the ice compartment 120.

An ice opening 127 for discharging ice is disposed at the lower side of the inner wall 114 of the door liner 112 defining the ice compartment 120. An ice duct 150 communicating with the ice opening 127 is disposed at the lower side of the ice compartment 120.

Figure 5:
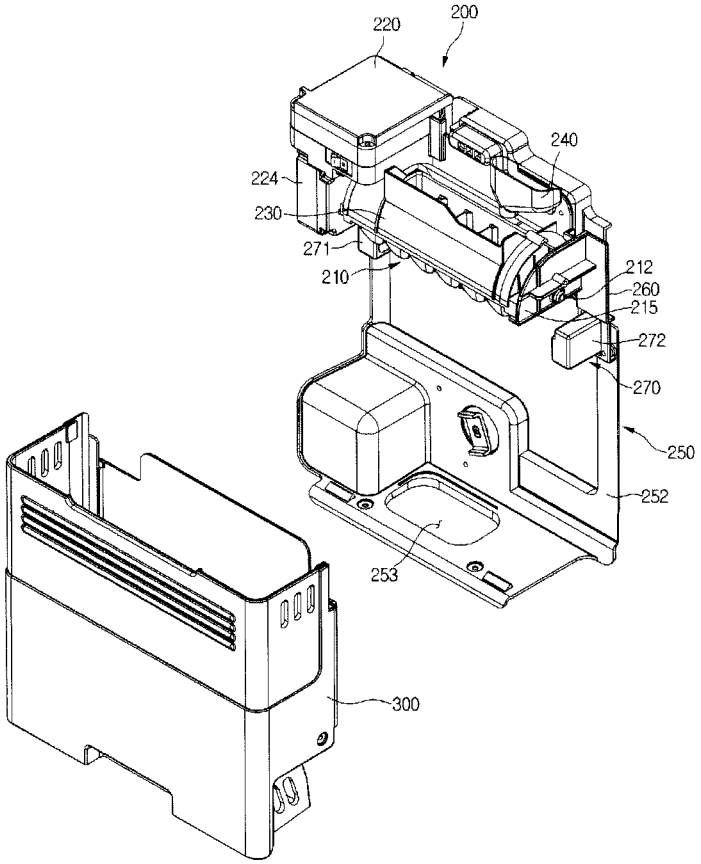
FIGS. 5 and 6 are perspective views of the ice making assembly according to the first embodiment.
Figure 6:
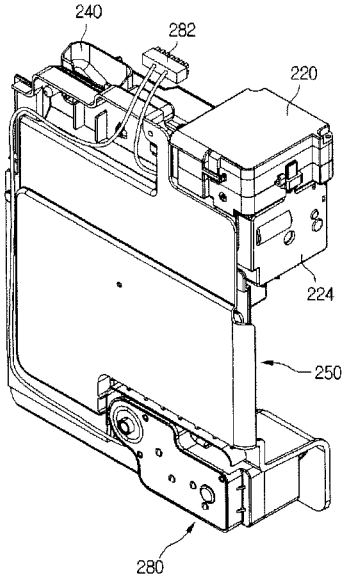

FIGS. 5 and 6 are perspective views of the ice making assembly according to the first embodiment.

Referring to FIGS. 3 to 6, the ice making assembly 200 defines a space where ice is generated, and includes an ice maker 210 supporting generated ice, a driving source 220 providing power for automatically rotating the ice maker 210 to remove ice from the ice maker 210, a gear box 224 transmitting the power of the driving source 220 to the ice maker 210, a cover 230 covering the ice maker 210 to prevent the overflow of water when the water is supplied to the ice maker 210, and a water guider 240 guiding water supplied from the water supply pipe 126 to the ice maker 210.

The ice making assembly 200 includes a support mechanism 250 including a seat part 215 on which the ice maker 210 is placed, an ice bin 300 storing ice removed from the ice maker 210, a full ice sensor 270 for sensing full ice state of the ice bin 300, and a motor assembly 280 selectively connected to the ice bin 300.

An electric wire connected to the motor assembly 280 and an electric wire connected to the driving source 220 are connected to a second connector 282 that is removably coupled to the first connector 125.

In detail, the support mechanism 250 includes a first support part 252 and a second support part 260 coupled with the first support part 252.

The first support part 252 is placed on the ice compartment 120. The motor assembly 280 is installed on the first support part 252. An ice opening 253 through which ice discharged from the ice bin 300 passes is disposed in the bottom surface of the first support part 252. The ice bin 300 is placed on the first support part 252. That is, the first support part 252 supports the ice bin 300.

When the ice bin 300 is placed on the first support part 252, the motor assembly 280 is connected to the ice bin 300. In the current embodiment, the state where the ice bin 300 is placed on the first support part 252 means the state where the ice compartment 120 accommodates the ice bin 300.

The seat part 215 on which the ice maker 210 is placed is installed on the second support part 260. The ice maker 210 includes a rotation shaft 212 at a side. The rotation shaft 212 is rotatably coupled to the seat part 215. An extension part (not shown) extending from the gear box 224 is connected to another side of the ice maker 210.

The full ice sensor 270 is installed on the second support part 260 at a position spaced apart from the ice maker 210. The full ice sensor 270 is disposed under the ice maker 210.

The full ice sensor 270 includes a transmission part 271 transmitting a signal, and a receiving part 272 spaced apart from the transmission part 271 and receiving a signal from the transmission part 271. The transmission part 271 and the receiving part 272 are disposed in the inner space of the ice bin 300 when the ice bin 300 is placed on the first support part 252.

Figure 7:
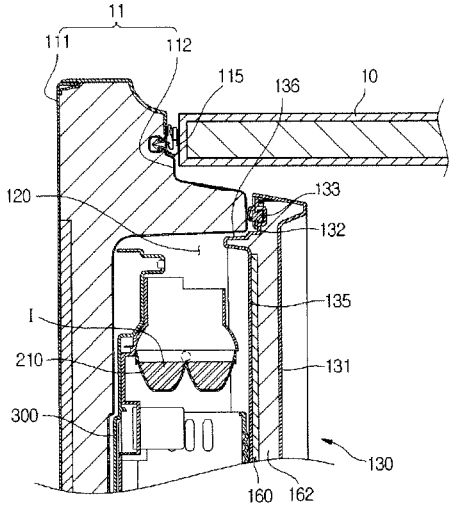
FIG. 7 is a cross-sectional view taken along line A-A of FIG. 1.
Figure 8:
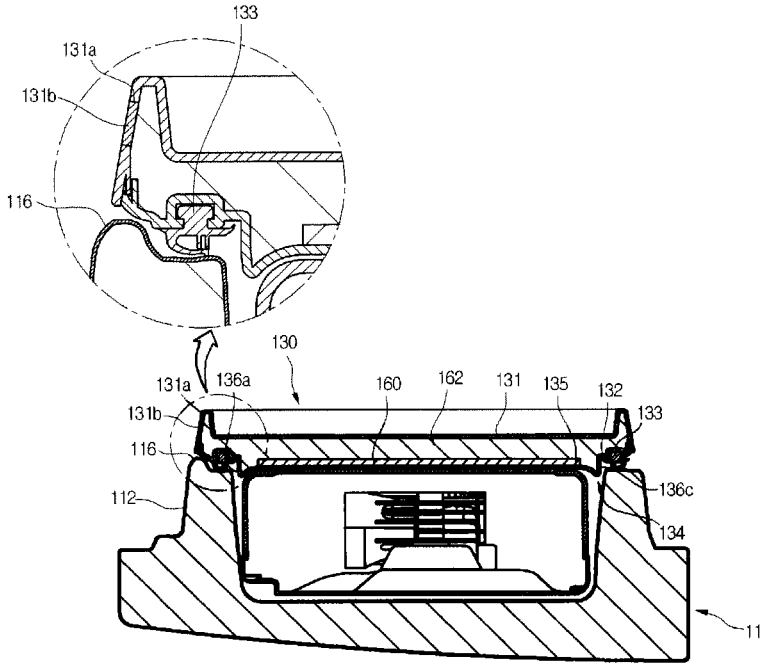
FIG. 8 is a cross-sectional view taken along line B-B of FIG. 2.

FIG. 7 is a cross-sectional view taken along line A-A of FIG. 1. FIG. 8 is a cross-sectional view taken along line B-B of FIG. 2.

Referring to FIGS. 3, 4, 7 and 8, the ice compartment door 130 includes the sealing parts 133 and 134 to prevent cool air communication between the refrigerator compartment 102 and the ice compartment 120 when the refrigerator compartment door 11 closes the refrigerator compartment 102.

In detail, the ice compartment door 130 includes an ice compartment door case 131, and an ice compartment door liner 132 connected to the ice compartment door case 131 and covering the ice compartment 120.

The sealing parts 133 and 134 are provided to the ice compartment door liner 132.

The sealing parts 133 and 134 may be referred to as first and second sealing parts, respectively. The second sealing part 134 for sealing is disposed inside the first sealing part 133. The second sealing part 134 is spaced apart from the first sealing part 133.

For example, the first sealing part 133 may include a rubber gasket. The first sealing part 133 is disposed at the edge of the ice compartment door liner 132. When the ice compartment door 130 closes the ice compartment 120, the first sealing part 133 contacts the door liner 112 of the refrigerator compartment door 11.

The second sealing part 134 may be integrally formed with the ice compartment door liner 132. Alternatively, the second sealing part 134 may be coupled to the ice compartment door liner 132. In the current embodiment, for example, the second sealing part 134 is integrally formed with the ice compartment door liner 132.

The second sealing part 134 includes a protrusion surface 135 protruding from the ice compartment door liner 132 to the ice compartment 120, and a protrusion part 136 protruding from the protrusion surface 135 to the ice compartment 120.

The protrusion part 136 may be disposed at the edge of the protrusion surface 135. The protrusion part 136 includes a couple of side protrusion parts **136*a* and 136*c* disposed at the edge on both sides of the protrusion surface 135, and an upper protrusion part 136*b* connecting the upper ends of the side protrusion parts 136*a* and 136*c*. The upper protrusion part 136*b* is disposed on the upper side of the protrusion surface 135**.

As described above, since the door supply duct 122 is disposed over the door return duct 124, cool air in the ice compartment 120 is concentrated to the upper side of the ice compartment 120.

Thus, a protrusion length of the upper protrusion part **136*b* is greater than the protrusion lengths of the side protrusion parts 136*a* and 136*c* to effectively prevent cool air leakage from the ice compartment 120**.

The protrusion lengths of the side protrusion parts **136*a* and 136*c* are greater on the upper side than on the lower side. For example, the protrusion lengths of the side protrusion parts 136*a* and 136*c*** may be decreased from the upper side to the lower side.

Since cool air in the ice compartment 120 is concentrated to the upper side of the ice compartment 120, the lower portion of the protrusion surface 135 does not require a protrusion part. However, a lower protrusion may be disposed at the lower portion of the protrusion surface 135 to prevent effectively cool air leakage of the ice compartment 120.

When the ice compartment door 130 closes the ice compartment 120, a part or whole of the second sealing part 134 may be inserted in the ice compartment 120. In the current embodiment, for example, the protrusion part 136 constituting the second sealing part 134 is inserted in the ice compartment 120.

When the protrusion part 136 is inserted in the ice compartment 120, the protrusion part 136 is disposed outside the ice making assembly 200.

A plurality of insulation materials, which are different in type from each other, are disposed in the ice compartment door 130. The insulation materials include a first insulation material 160 and a second insulation material 162.

The first insulation material 160 is a vacuum insulation panel (VIP), and the second insulation material 162 is expanded poly styrene (EPS) or expanded polyurethane.

The vacuum insulation panel includes a plurality of thin metal plates coupled to each other, and an inner vacuum space. The vacuum space has about 0.0001 atmospheres or less, which is close to a vacuum condition. Adsorbent such as silica gel may be provided to the vacuum space to remove moisture due to temperature variation in the vacuum space.

Alternatively, the vacuum insulation panel may include a core material formed by compressing a glass fiber, and a sealing cover surrounding the core material.

Since the vacuum insulation panel may have a well known structure, a description thereof will be omitted.

The vacuum insulation panel has higher insulation performance per unit thickness than that of expanded poly styrene. Thus, the vacuum insulation panel may have a thickness less than that of expanded poly styrene to obtain the same insulation performance as that of the expanded poly styrene. In the current embodiment, since the ice compartment door 130 includes the vacuum insulation panel, the thickness of the ice compartment door 130 can be decreased.

The ice compartment door case 131 has an opening 131*a* to inject liquid for foaming. After the foaming, the opening 131*a* may be covered with an opening cover 131*b*.

A method of assembling the ice compartment door 130 will now be described. The first insulation material 160 is fixed through adhesive to one of the ice compartment door liner 132 and the ice compartment door case 131. For example, the first insulation material 160 may be fixed to the ice compartment door liner 132.

Next, the ice compartment door case 131 is coupled with the ice compartment door liner 132 to complete the appearance of the ice compartment door 130. Next, foaming liquid is injected through the opening 131*a*. After a predetermined time is elapsed, the opening cover 131*b* is coupled to the ice compartment door case 131 to cover the opening 131*a*, so that the assembling of the ice compartment door 130 is completed.

Referring to FIG. 8, the door liner 112 of the refrigerator compartment door 11 includes a third sealing part 116 for further preventing cool air leakage of the ice compartment 120. In detail, the third sealing part 116 at the door liner 112 is adjacent to the hinge 139 of the ice compartment door 130. The third sealing part 116 vertically extends at the door liner 112, and protrudes from the door liner 112.

When the ice compartment door 130 closes the ice compartment 120, the third sealing part 116 is disposed outside the first sealing part 133.

Since the ice compartment door 130 is rotated through the hinge 139, the sealing performance of the first sealing part 133 may be insufficient at a position adjacent to the hinge 139. Thus, according to the current embodiment, the third sealing part 116 is further provided to improve the sealing performance.

As such, according to the current embodiment, since the sealing parts are provided to prevent the communication between the ice compartment and the refrigerator compartment, temperature increase of the refrigerator compartment and temperature decrease of the ice compartment caused by the communication between the ice compartment and the refrigerator compartment can be prevented.

Specifically, since the second sealing part disposed inside the first sealing part is inserted in the ice compartment, the preventing of the communication between the ice compartment and the refrigerator compartment can be further improved.

In addition, since the third sealing part is disposed at the portion adjacent to the hinge of the ice compartment door, when the sealing performance of the first sealing part is insufficient, the third sealing part maintains the sealing performance.

In addition, since the ice compartment door includes both the vacuum insulation panel and the expanded poly styrene, the thickness of the ice compartment can be reduced.

Figure 9:
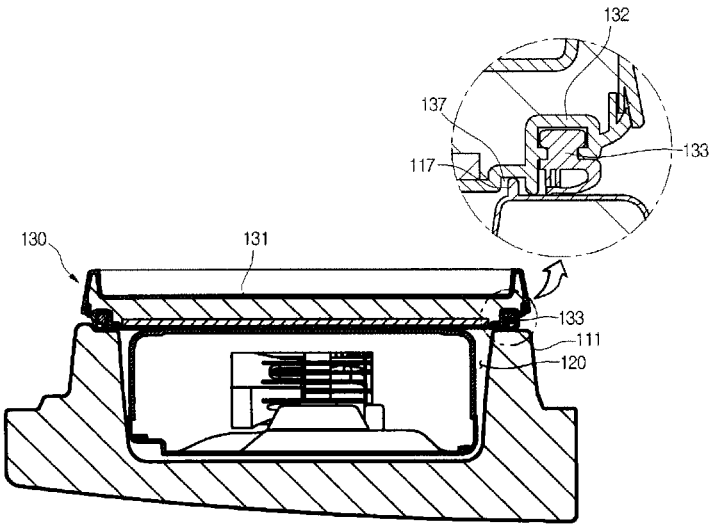
FIG. 9 is a cross-sectional view taken along line B-B of FIG. 2 according to a second embodiment.

FIG. 9 is a cross-sectional view taken along line B-B of FIG. 2 according to a second embodiment.

The current embodiment is the same as the first embodiment except for a structure of a second sealing part. Thus, the current embodiment will now be described with respect to the structure of the second sealing part, and a description of the same part as that of the first embodiment will be omitted.

Referring to FIG. 9, a sealing part 117 is provided to the door liner 112. In detail, the sealing part 117 protrudes from the door liner 112 to the ice compartment door 130.

The ice compartment door liner 132 includes a receiving part 137 for receiving at least one portion of the sealing part 117. The receiving part 137 is formed by recessing the ice compartment door liner 132. That is, at least one portion of the sealing part 117 is received by the ice compartment door 130.

Thus, when the ice compartment door 130 closes the ice compartment 120, the first sealing part 133 contacts the door liner 112 of the refrigerator compartment door 11, and the sealing part 117 is received by the receiving part 137.

According to the embodiments, since the sealing parts are provided to prevent the communication between the ice compartment and the refrigerator compartment, temperature increase of the refrigerator compartment and temperature decrease of the ice compartment caused by the communication between the ice compartment and the refrigerator compartment can be prevented.

Specifically, since the second sealing part disposed inside the first sealing part is inserted in the ice compartment, the preventing of the communication between the ice compartment and the refrigerator compartment can be further improved.

In addition, since the third sealing part is disposed at the portion adjacent to the hinge of the ice compartment door, when the sealing performance of the first sealing part is insufficient, the third sealing part maintains the sealing performance.

In addition, since the ice compartment door includes both the vacuum insulation panel and the expanded poly styrene, the thickness of the ice compartment can be reduced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a refrigerator storage compartment;

a refrigerator door configured to open and close the refrigerator storage compartment, the refrigerator door having a door liner which protrudes from an edge portion of a rear surface thereof;

an ice compartment located at a space which is defined by the door liner;

an ice maker provided within the ice compartment, the ice maker being configured to generate ice cubes and be twisted by rotating to separate the ice cubes from the ice maker by weight of the ice cubes;

an ice bin detachably mounted within the ice compartment and disposed below the ice maker;

an ice compartment door rotatably coupled to a side edge portion of the rear surface of the refrigerator door by a hinge and configured to open or close the ice compartment, the ice compartment door including:

a front surface which is exposed to the refrigerator storage compartment; and a rear surface which is exposed to the ice compartment;

a plurality of sealing parts configured to reduce leakage of cold air from the ice compartment, the plurality of sealing parts including:

a first sealing part including a sealing gasket arranged along four edge portions of the rear surface of the ice compartment door;

a second sealing part located at an inner position relative to the first sealing part such that the second sealing part is located a first distance away from the first sealing part in a direction towards a center of the ice compartment door; and a third sealing part located at an outer position relative to the first sealing part such that the third sealing part is located a second distance away from the first sealing part in a direction away from the center of the ice compartment door, wherein the first sealing part, the second sealing part, and the third sealing part are independently provided from each other;

at least one basket detachably mounted on the ice compartment door;

a motor assembly that is mounted on the refrigerator door and that is configured to selectively connect to the ice bin; and a dispenser provided on the refrigerator door and configured to communicate with the ice bin, wherein the ice bin comprises:

a discharge opening provided in a bottom portion of the ice bin; and a rotation axis that horizontally crosses a lower portion of the ice bin and that is configured to operatively connect to the motor assembly, wherein ice cubes drop across the rotation axis from a position above the rotation axis to a position below the rotation axis based on rotation of the rotation axis, wherein the ice compartment includes:

a first side wall portion that extends vertically;

a second side wall portion that is an opposite side of the first side wall and extends vertically;

an upper wall portion extending horizontally to connect upper ends of the first and second side wall portions; and a lower wall portion extending horizontally to connect lower ends of the first and second side wall portions, wherein the third sealing part further protrudes from an end of the door liner defining the first side wall portion of the ice compartment towards the rear surface of the ice compartment door when the ice compartment door is in a closed position, and is configured to vertically extend along the first side wall portion with a predetermined width that is less than a width of the first side wall portion, wherein the hinge of the ice compartment door is coupled to the first side wall portion such that the third sealing part is closer to the hinge of the ice compartment door than to the second side wall portion, wherein the second sealing part includes:

a protrusion surface that protrudes from the rear surface of the ice compartment door and that is configured to contact a front surface of the ice bin based on the ice compartment door being oriented in a closed position;

a pair of side protrusion parts at both side edges of the protrusion surface; and an upper protrusion part connecting the side protrusion parts to each other, wherein the upper protrusion part has a protrusion height greater than protrusion heights of the side protrusion parts.

2. The refrigerator according to claim 1, further comprising a vacuum insulation panel which is disposed within the ice compartment door, wherein the vacuum insulation panel is disposed in the protrusion surface and contacts the front surface of the ice bin based on the ice compartment door being oriented in a closed position.

3. The refrigerator according to claim 2, wherein the vacuum insulation panel is located closer to the rear surface than the front surface of the ice compartment door.

4. The refrigerator according to claim 1:

wherein the first sealing part is disposed at the edge of the ice compartment door liner; and wherein the second sealing part is integrally formed with the ice compartment door liner.

5. The refrigerator according to claim 1, wherein protrusion lengths of the side protrusion parts are greater on the upper side than on the lower side such that the protrusion lengths of the side protrusion parts decrease from the upper side to the lower side.

6. The refrigerator according to claim 1, wherein the third sealing part protrudes beyond at least a portion of the first sealing part and the second sealing part when the ice compartment door is in a closed position.

7. The refrigerator according to claim 1, wherein the third sealing part is located at a first side of the door liner and protrudes towards the rear surface of the ice compartment door further than any portion of a second side of the door liner, the second side of the door liner being opposite of the first side of the door liner.

8. The refrigerator according to claim 1, wherein a lower portion of the protrusion surface does not include an additional protrusion part.

9. The refrigerator according to claim 1, wherein the third sealing part vertically extends in a protruded manner along an entire height of the ice compartment door and is oriented parallel to an axis of the hinge to which the third sealing part is adjacent.

10. The refrigerator according to claim 9, wherein a portion of the door liner that defines a side of the ice compartment opposite of the hinge does not include a protruding part such that the third sealing part protrudes further than the portion of the door liner that defines a side of the ice compartment opposite of the hinge.

* * * * *